US010699619B1

(12) United States Patent
Ma

(10) Patent No.: US 10,699,619 B1
(45) Date of Patent: Jun. 30, 2020

(54) PIXEL DRIVING CIRCUIT AND DISPLAY DEVICE

(71) Applicant: Wuhan China Star Optoelectronics Semiconductor Display Technology Co., Ltd., Wuhan (CN)

(72) Inventor: Weixin Ma, Wuhan (CN)

(73) Assignee: Wuhan China Star Optoelectronics Semiconductor Display Technology Co., Ltd., Wuhan (CN)

( * ) Notice: Subject to any disclaimer, the term of this patent is extended or adjusted under 35 U.S.C. 154(b) by 0 days.

(21) Appl. No.: 16/349,992

(22) PCT Filed: Dec. 27, 2018

(86) PCT No.: PCT/CN2018/124267
§ 371 (c)(1),
(2) Date: May 15, 2019

(87) PCT Pub. No.: WO2020/062676
PCT Pub. Date: Apr. 2, 2020

(30) Foreign Application Priority Data

Sep. 27, 2018 (CN) ..... 2018 1 1133303

(51) Int. Cl.
*G09G 3/20* (2006.01)

(52) U.S. Cl.
CPC ..... *G09G 3/20* (2013.01); *G09G 2300/0408* (2013.01); *G09G 2300/0426* (2013.01); *G09G 2300/0876* (2013.01); *G09G 2310/027* (2013.01); *G09G 2310/0267* (2013.01); *G09G 2310/08* (2013.01); *G09G 2320/0247* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 2004/0246208 | A1 | 12/2004 | Machida | |
| 2016/0307509 | A1 | 10/2016 | Nie | |
| 2017/0200781 | A1 | 7/2017 | Jin | |
| 2017/0337878 | A1* | 11/2017 | Kim | G09G 3/3258 |
| 2019/0088689 | A1 | 3/2019 | Umezaki | |
| 2019/0103455 | A1* | 4/2019 | Song | H01L 27/3265 |
| 2019/0164491 | A1* | 5/2019 | Kim | H01L 27/3248 |
| 2019/0340975 | A1* | 11/2019 | Zhai | G09G 3/2014 |
| 2020/0005706 | A1* | 1/2020 | Li | G09G 3/3266 |
| 2020/0005708 | A1* | 1/2020 | Hwang | G09G 3/3258 |

(Continued)

FOREIGN PATENT DOCUMENTS

| | | |
|---|---|---|
| CN | 1726525 | 1/2006 |
| CN | 104217675 | 12/2014 |

(Continued)

*Primary Examiner* — Tony O Davis

(57) ABSTRACT

A pixel driving circuit and a display device are disclosed. In the pixel driving circuit, a transistor, whose a gate electrode is driven by an enabling signal, is added to a gate electrode of a first transistor in an original pixel driving circuit while a regular square wave signal is transmitted by the enabling signal in a displaying stage and while input frequency of the enabling signal makes pixels blink without being recognized by human eyes, causing a first transistor, a fifth transistor, and a sixth transistor to be in an off state for a part of time of the displaying stage.

12 Claims, 2 Drawing Sheets

(56) References Cited

U.S. PATENT DOCUMENTS

| | | | | |
|---|---|---|---|---|
| 2020/0006401 | A1* | 1/2020 | Hwang | H01L 27/124 |
| 2020/0006446 | A1* | 1/2020 | Lee | H01L 51/524 |
| 2020/0006455 | A1* | 1/2020 | Park | H01L 27/3276 |
| 2020/0006461 | A1* | 1/2020 | Cho | H01L 27/124 |
| 2020/0027380 | A1* | 1/2020 | Lee | H01L 51/0097 |
| 2020/0042759 | A1* | 2/2020 | Kim | G06F 3/0412 |
| 2020/0043406 | A1* | 2/2020 | Cha | G09G 3/325 |
| 2020/0044008 | A1* | 2/2020 | Lee | H01L 51/0097 |
| 2020/0052056 | A1* | 2/2020 | Park | H01L 27/12 |
| 2020/0058723 | A1* | 2/2020 | Lee | H01L 27/3276 |
| 2020/0074936 | A1* | 3/2020 | Chu | G09G 3/3266 |
| 2020/0075702 | A1* | 3/2020 | Zhang | H01L 27/3276 |
| 2020/0083309 | A1* | 3/2020 | Wang | H01L 27/3265 |

FOREIGN PATENT DOCUMENTS

| | | |
|---|---|---|
| CN | 104575395 | 4/2015 |
| CN | 107221289 | 9/2017 |
| JP | 2016-129338 | 7/2016 |

* cited by examiner

PIXEL DRIVING CIRCUIT AND DISPLAY DEVICE

RELATED APPLICATIONS

This application is a National Phase of PCT Patent Application No. PCT/CN2018/124267 having International filing date of Dec. 27, 2018, which claims the benefit of priority of Chinese Patent Application No. 201811133303.5 filed on Sep. 27, 2018. The contents of the above applications are all incorporated by reference as if fully set forth herein in their entirety.

FIELD AND BACKGROUND OF THE INVENTION

The invention relates to the field of liquid crystal display technology, and more particularly, to a pixel driving circuit and a display device.

Currently, display devices with active-matrix organic light emitting diode (AMOLED) panels, which consist of columns and rows of AMOLED pixels, are widely used in a variety of products. For AMOLED pixels, a pixel driving circuit constructed in thin film transistors (TFTs) supplies corresponding currents to organic light-emitting diodes (OLEDs). In a case of a basic pixel driving circuit for AMOLED, as shown in FIG. 1, is specifically a 7T1C circuit that includes seven transistors and a capacitor.

FIG. 1 is equivalent to a conventional 7T1C pixel driving circuit, and FIG. 2 shows a driving time sequence diagram. The working principle of the 7T1C pixel driving circuit is as follows: in a preparation stage t1, a second scan signal scan[n−1] is at a low voltage level, and thus a fourth transistor T4 turns on, a potential of a reference point A becomes low, and a first capacitor C1 is proceeding with charge; in a compensation stage t2 of a threshold voltage Vth of a first transistor T1, a first scan signal scan[n] is at a low voltage level, and thus a second transistor T2, a third transistor T3, and a seventh transistor T7 turn on. Owing to a negative voltage applied on a gate electrode of the first transistor T1, a source electrode and a drain electrode of the first transistor T1 form a short circuit, and the potential of the reference point A follows the relation expression: $|V_A|>|Vth|$. That is, by this time, the first transistor T1 becomes a diode and turns on, the reference point A is charged by a voltage signal of grayscale data Vdata through the first transistor T1 until the potential of the first reference point A turns into be equal to: Vdata−|Vth| while the first transistor T1 is in a cut-off state, and moreover a light emitting device OLED is restored because of turning on the seventh transistor T7; in a displaying stage t3, an enabling signal EM is at a low voltage level, and a fifth transistor T5 and a sixth transistor T6 turn on, wherein a gate-to-source voltage of the first transistor T1 is calculated by: Vgs=Vdd−(Vdata−|Vth|), and a current, which passes through the source electrode and the drain electrode of the first transistor T1 and then passes through the light emitting device OLED, is calculated according to the formula:

$$I_{ds1} = \left(\frac{1}{2}\right)K[V_{dd} - (V_{data} - |V_{th}|) - |V_{th}|]^2 = \left(\frac{1}{2}\right)K(V_{dd} - V_{data})^2,$$

where K=CoxμW/L. The light emitting device OLED works in the displaying stage t3. For example, a display panel with resolution of 1440*2960/18.5:9. Scanning frequency of the pixel driving circuit is 60 hertz, that is, a gate driving time t1 or a gate driving time t2 is equal to: 1/60/(1440+blank), and is approximately 6 microseconds, wherein the blank, an amount of displacement, can be ignored. Because a frame of time is 1/60 seconds and is equal to: t1+t2+t3, a driving time, calculated by: t3=1/60−t1−t2, is 16.7 milliseconds. However, for the TFTs that turn on in the stage t3, the driving time is very long. The reasons why the first transistor T1, the fifth transistor T5 and the sixth transistor T6 turn on are that the enabling signal EM is at a low voltage level for a long time and the gate electrode of the first transistor T1 is also at a low voltage level for a long time in a light emitting stage due to the first capacitor C1, causing the first transistor T1, the fifth transistor T5, and the sixth transistor T6 to be in an on state for a long time.

Because TFTs are in an on state for a long time, TFT devices are in a bias stress stage for a long time, causing electric characteristics of the devices, such as a turn-on voltage and an electron mobility, to drift. Thus, the display performance of the whole screen is affected, and lifespan of the TFT devices reduce.

In view of this, a kind of solution is urgently required to solve the foregoing problems.

SUMMARY OF THE INVENTION

The object of the invention is to provide a pixel driving circuit, wherein, in a displaying stage, a first transistor, a fifth transistor and a sixth transistor are in an off state for a part of time, and thus a device is prevented from being in an on state for a long time without damages and the lifetime of a TFT device is increased.

According to one aspect of the invention, the invention provides a pixel driving circuit, including: a light emitting device, a first transistor, a second transistor, a third transistor, a fourth transistor, a fifth transistor, a sixth transistor, a seventh transistor and a first capacitor, wherein a first end of the light emitting device is electrically connected to a drain electrode of the sixth transistor and a drain electrode of the seventh transistor, a second end of the light emitting device is grounded, a positive terminal of the first capacitor receives a power voltage signal, a negative terminal of the first capacitor is electrically connected to a source electrode of the fourth transistor and a drain electrode of the third transistor, a gate electrode of the fourth transistor receives a second scan signal, a drain electrode of the fourth transistor receives a working voltage signal, a drain electrode of the second transistor receives a voltage signal of grayscale data, a source electrode of the second transistor is electrically connected to a source electrode of the first transistor and a drain electrode of the fifth transistor, a drain electrode of the first transistor is electrically connected to a source electrode of the sixth transistor, a gate electrode of the first transistor is electrically connected to the negative terminal of the first capacitor, the source electrode of the sixth transistor is electrically connected to a source electrode of the third transistor, a gate electrode of the sixth transistor and a gate electrode of the fifth transistor receive an enabling signal, a gate electrode of the third transistor receives a first scan signal, the drain electrode of the third transistor is electrically connected to the negative terminal of the first capacitor, a source electrode of the fifth transistor is electrically connected to the positive terminal of the first capacitor, a source electrode of the seventh transistor is electrically connected to the drain electrode of the fourth transistor, and a gate electrode of the seventh transistor receives the first scan signal; and an eighth transistor, wherein a drain electrode of the eighth transistor is electrically connected to the gate electrode of the first transistor, a gate electrode of the eighth transistor receives the enabling signal, and a source electrode of the eighth transistor is electrically connected to the negative terminal of the first capacitor; wherein: in a first time span, when the second scan signal is at a low voltage level, the fourth transistor is in a conduction state, a first reference point at the negative terminal of the first capacitor turns into be at a low voltage level, and the first capacitor is in a charging state, wherein the first time span starts while the charge of the first capacitor begins, and the first time span ends while the charge of the first capacitor finishes; and in a second time span, when the first scan signal is at a low voltage level, the second transistor, the third transistor and the seventh transistor are in a conduction state, wherein the second time span starts while the charge of the first capacitor finishes, and the second time span ends while a potential of the first reference point at the negative terminal of the first capacitor turns into be the difference between a voltage of grayscale data and a threshold voltage of the first transistor, and wherein the first transistor is in a cut-off state.

According to another aspect of the invention, the invention provides a pixel driving circuit, including: a light emitting device, a first transistor, a second transistor, a third transistor, a fourth transistor, a fifth transistor, a sixth transistor, a seventh transistor and a first capacitor, wherein a first end of the light emitting device is electrically connected to a drain electrode of the sixth transistor and a drain electrode of the seventh transistor, a second end of the light emitting device is grounded, a positive terminal of the first capacitor receives a power voltage signal, a negative terminal of the first capacitor is electrically connected to a source electrode of the fourth transistor and a drain electrode of the third transistor, a gate electrode of the fourth transistor receives a second scan signal, a drain electrode of the fourth transistor receives a working voltage signal, a drain electrode of the second transistor receives a voltage signal of grayscale data, a source electrode of the second transistor is electrically connected to a source electrode of the first transistor and a drain electrode of the fifth transistor, a drain electrode of the first transistor is electrically connected to a source electrode of the sixth transistor, a gate electrode of the first transistor is electrically connected to the negative terminal of the first capacitor, the source electrode of the sixth transistor is electrically connected to a source electrode of the third transistor, a gate electrode of the sixth transistor and a gate electrode of the fifth transistor receive an enabling signal, a gate electrode of the third transistor receives a first scan signal, the drain electrode of the third transistor is electrically connected to the negative terminal of the first capacitor, a source electrode of the fifth transistor is electrically connected to the positive terminal of the first capacitor, a source electrode of the seventh transistor is electrically connected to the drain electrode of the fourth transistor, and a gate electrode of the seventh transistor receives the first scan signal; and an eighth transistor, wherein a drain electrode of the eighth transistor is electrically connected to the gate electrode of the first transistor, a gate electrode of the eighth transistor receives the enabling signal, and a source electrode of the eighth transistor is electrically connected to the negative terminal of the first capacitor.

In an embodiment of the invention, in a first time span, when the second scan signal is at a low voltage level, the fourth transistor is in a conduction state, a first reference point at the negative terminal of the first capacitor turns into be at a low voltage level, and the first capacitor is in a charging state, and wherein the first time span starts while the charge of the first capacitor begins, and the first time span ends while the charge of the first capacitor finishes.

In an embodiment of the invention, in a second time span, when the first scan signal is at a low voltage level, the second transistor, the third transistor and the seventh transistor are in a conduction state, wherein the second time span starts while the charge of the first capacitor finishes, and the second time span ends while a potential of the first reference point at the negative terminal of the first capacitor turns into be the difference between a voltage of grayscale data and a threshold voltage of the first transistor, and wherein the first transistor is in a cut-off state.

In an embodiment of the invention, when a gate voltage of the first transistor is larger than the threshold voltage of the first transistor, the first transistor is in a conduction state, and the first reference point at the negative terminal of the first capacitor is charged by the voltage signal of grayscale data until the potential of the first reference point turns into be the difference between the voltage of grayscale data and the threshold voltage of the first transistor while the first transistor turns into be in the cut-off state.

In an embodiment of the invention, in a third time span, when the enabling signal is at a high voltage level, the first transistor, the eighth transistor, the fifth transistor and the sixth transistor are in a cut-off state, wherein the third time span starts while a potential of the first reference point turns into be the difference between the voltage of grayscale data and the threshold voltage of the first transistor and while the first transistor turns into be in a cut-off state, and the third time span ends while a timing period of the pixel driving circuit ends.

In an embodiment of the invention, the third time span comprises a plurality of first durations of high voltage level, in which the enabling signal keeps high.

In an embodiment of the invention, a first duration of high voltage level in which the enabling signal keeps high is greater than or equal to the sum of a first time span and a second time span.

In an embodiment of the invention, in a third time span, when the enabling signal is at a low voltage level, the first transistor, the eighth transistor, the fifth transistor and the sixth transistor are in a conduction state.

In an embodiment of the invention, a current which passes through the first transistor is calculated according to the formula:

$$I_{ds1} = \left(\frac{1}{2}\right)K[V_{dd} - (V_{data} - |V_{th}|) - |V_{th}|]^2 = \left(\frac{1}{2}\right)K(V_{dd} - V_{data})^2,$$

where K is a conducting parameter.

In an embodiment of the invention, the first transistor, the second transistor, the third transistor, the fourth transistor, the fifth transistor, the sixth transistor, the seventh transistor and the eighth transistor are P-type transistors.

According to another aspect of the invention, the invention further provides a display device, including the foregoing pixel driving circuit.

The advantage of the invention is that, in the pixel driving circuit, a TFT, whose a gate electrode is driven by an enabling signal (i.e., EM signal), is added to a gate electrode of a first transistor in an original pixel driving circuit while a regular square wave signal is transmitted by the enabling signal in a displaying stage and while input frequency of the enabling signal makes pixels blink without recognizing by human eyes, causing a first transistor, a fifth transistor and a sixth transistor to be in an off state for a part of time of the displaying stage. Therefore, not only are devices prevented from being in an on state for a long time without damages, but also lifetimes of TFT devices and the whole circuit can be increased.

BRIEF DESCRIPTION OF THE SEVERAL VIEWS OF THE DRAWINGS

In order to more clearly illustrate technical solutions in the embodiments of the invention, the drawings required for describing the embodiments will be briefly introduced below. It is obvious that the following drawings are merely some embodiments of the invention, and a person having ordinary skill in this field can obtain other drawings according to these drawings under the premise of not paying creative works.

DETAILED DESCRIPTION OF SPECIFIC EMBODIMENTS OF THE INVENTION

Figure 1:
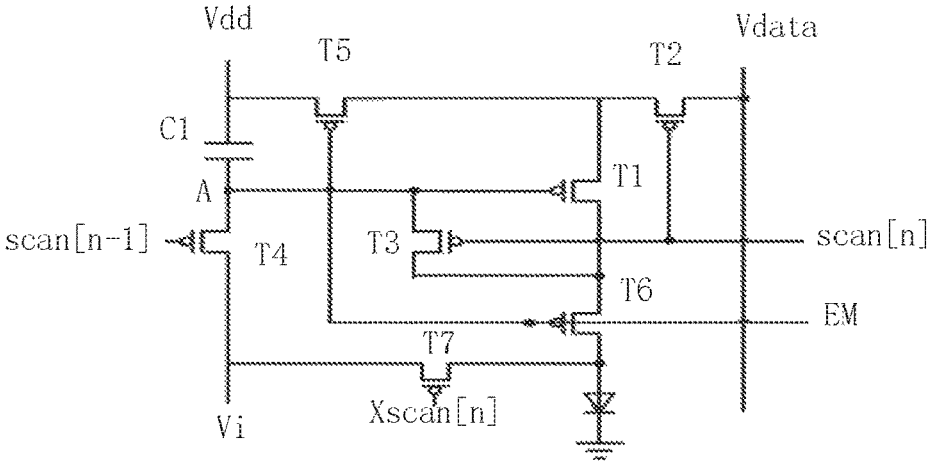
FIG. 1 is an equivalent circuit diagram of a conventional pixel driving circuit.
Figure 2:
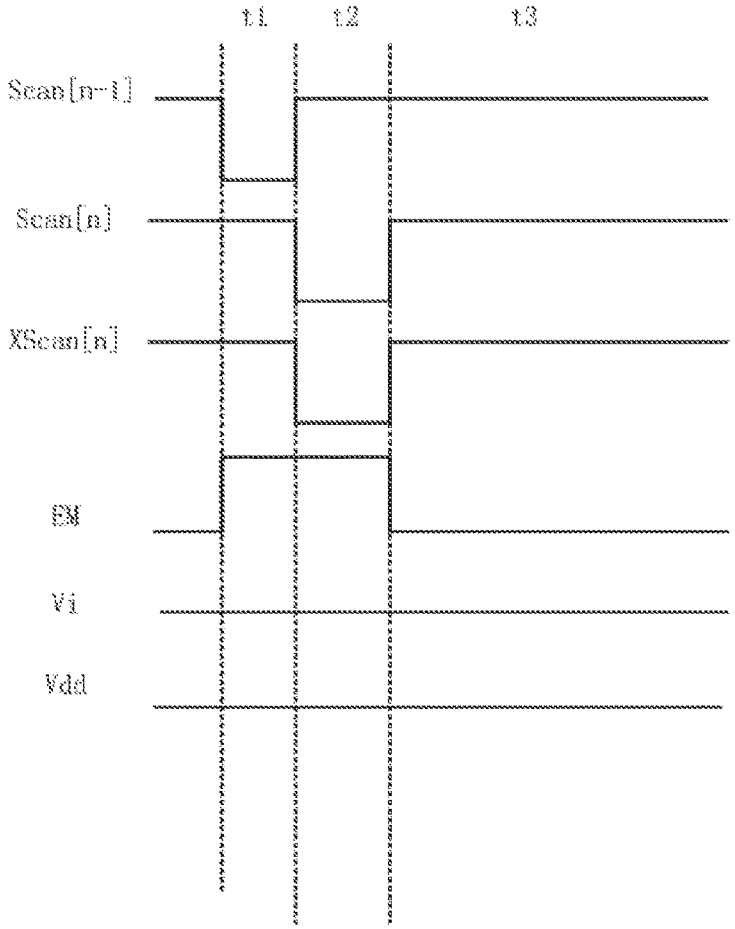
FIG. 2 is a driving time sequence diagram of the pixel driving circuit described in FIG. 1.

The technical solutions in the embodiments of the present invention will be described clearly and completely in conjunction with the accompanying drawings in the embodiments of the present invention. Apparently, the described embodiments are merely a part of the embodiments of the present invention instead of all of the embodiments. All of the other embodiments obtained by those skilled in the related art without creative efforts, based on the embodiments in the present invention, belong to the protection scope of the present invention.

Terms "first", "second", "third" and the like (if existing) in the specification, the claims, and the accompanying drawings are used to distinguish similar objects instead of describing a specific sequence or a precedence order. It should be understood that the described objects can be exchanged in any suitable situations. In addition, terms "include", "have" and any variations thereof intend to cover nonexclusive inclusions.

In this patent document, the accompanying drawings discussed below and the various embodiments used to describe the principles of the present invention are by way of illustration only and should not be construed to limit the scope of the invention. Those skilled in the art will understand that the principles of the present invention can be implemented in any suitably arranged system. The exemplary embodiments will be described in detail and examples of these embodiments are illustrated in the accompanying drawings. In addition, a terminal according to exemplary embodiments will be described in detail with reference to the accompanying drawings. Like reference numerals in the accompanying drawings denote like elements.

The terms used in the present specification are merely used to describe particular embodiments, and are not intended to reveal the concepts of the present invention. An expression used in the singular form encompasses the expression in the plural form, unless it has a clearly different meaning in the context. In the present specification, it is to be understood that the terms such as "including," "having," and "comprising" are intended to indicate the existence of the features, numbers, steps, actions, or combinations thereof disclosed in the specification, and are not intended to preclude the possibility that one or more other features, numbers, steps, actions, or combinations thereof can exist or can be added. Like reference numerals in the accompanying drawings denote like parts.

A pixel driving circuit and a display device, provided in the embodiments of the present invention, will be respectively explained in detail below.

Figure 3:
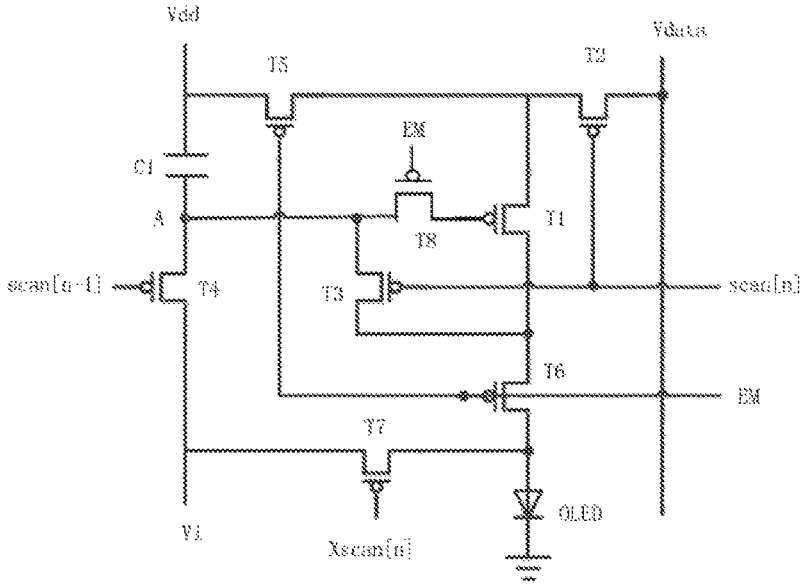
FIG. 3 is a circuit diagram of a pixel driving circuit according to one embodiment of the present invention.
Figure 4:
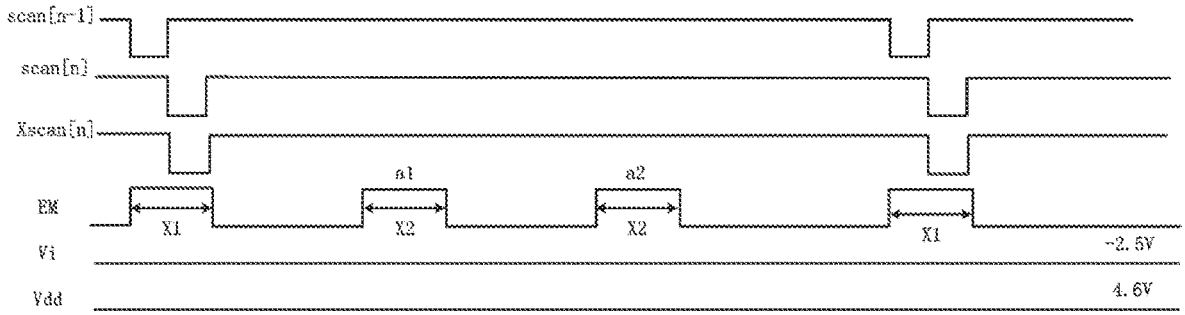
FIG. 4 is a driving time sequence diagram of the pixel driving circuit described in FIG. 3, wherein an enabling signal has a timing with a high-level signal.

Referring to FIG. 3 and FIG. 4, a pixel driving circuit is provided in an embodiment of the invention.

The pixel driving circuit includes: a light emitting device, such as organic light-emitting diode (OLED), a first transistor T1, a second transistor T2, a third transistor T3, a fourth transistor T4, a fifth transistor T5, a sixth transistor T6, a seventh transistor T7, and a first capacitor C1, wherein a first end of the light emitting device OLED is electrically connected to a drain electrode of the sixth transistor T6 and a drain electrode of the seventh transistor T7, a second end of the light emitting device OLED is grounded, a positive terminal of the first capacitor C1 receives a power voltage signal Vdd, a negative terminal of the first capacitor C1 is electrically connected to a source electrode of the fourth transistor T4 and a drain electrode of the third transistor T3, a gate electrode of the fourth transistor T4 receives a second scan signal scan[n−1], a drain electrode of the fourth transistor T4 receives a working voltage signal Vi, a drain electrode of the second transistor T2 receives a voltage signal of grayscale data Vdata, a source electrode of the second transistor T2 is electrically connected to a source electrode of the first transistor T1 and a drain electrode of the fifth transistor T5, a drain electrode of the first transistor T1 is electrically connected to a source electrode of the sixth transistor T6, a gate electrode of the first transistor T1 is electrically connected to the negative terminal of the first capacitor C1, the source electrode of the sixth transistor T6 is electrically connected to a source electrode of the third transistor T3, a gate electrode of the sixth transistor T6 and a gate electrode of the fifth transistor T5 receive an enabling signal EM, a gate electrode of the third transistor T3 receives a first scan signal scan[n], the drain electrode of the third transistor T3 is electrically connected to the negative terminal of the first capacitor C1, a source electrode of the fifth transistor T5 is electrically connected to the positive terminal of the first capacitor C1, a source electrode of the seventh transistor T7 is electrically connected to the drain electrode of the fourth transistor T4, and a gate electrode of the seventh transistor T7 receives the first scan signal scan[n]; and an eighth transistor T8, wherein a drain electrode of the eighth transistor T8 is electrically connected to the gate electrode of the first transistor T1, a gate electrode of the eighth transistor T8 receives the enabling signal EM, and a source electrode of the eighth transistor T8 is electrically connected to the negative terminal of the first capacitor C1.

In the embodiment, the first transistor T1, the second transistor T2, the third transistor T3, the fourth transistor T4, the fifth transistor T5, the sixth transistor T6, the seventh transistor T7, and the eighth transistor T8 are P-type transistors. Thus, the gate electrodes of the transistors meet the conditions: receiving a low voltage level in order that the transistors are in a conduction state; and receiving a high voltage level in order that the transistors are in a cut-off state.

In the embodiment, in a first time span, the gate electrode of the fourth transistor T4 is controlled by the second scan signal scan[n−1], and thus, when the second scan signal scan[n−1] is at a low voltage level, the fourth transistor T4 is in a conduction state, a first reference point at the negative terminal of the first capacitor C1 turns into be at a low voltage level, and the first capacitor C1 is in a charging state, wherein the first time span starts while the charge of the first capacitor C1 begins, and the first time span ends while the charge of the first capacitor C1 finishes.

In a second time span, each of the gate electrodes of the second transistor T2, the third transistor T3, and the seventh transistor T7 is controlled by the first scan signal scan[n], and thus, when the first scan signal scan[n] is at a low voltage level, the second transistor T2, the third transistor T3, and the seventh transistor T7 are in a conduction state, wherein the second time span starts while the charge of the first capacitor C1 finishes, and the second time span ends while a potential of the first reference point at the negative terminal of the first capacitor C1 turns into be the difference between a voltage of grayscale data Vdata and a threshold voltage Vth of the first transistor T1, and wherein the first transistor T1 is in a cut-off state.

In the second time span, when a gate voltage of the first transistor T1 is larger than the threshold voltage Vth of the first transistor T1, the first transistor T1 is in a conduction state and can be regarded as a conducting diode, and the first reference point at the negative terminal of the first capacitor C1 is charged by the voltage signal of grayscale data Vdata until the potential of the first reference point turns into be the difference between the voltage of grayscale data Vdata and the threshold voltage Vth of the first transistor T1 while the first transistor T1 turns into be in the cut-off state. That is to say, when the potential of the first reference is equal to: Vdata−|Vth|, where Vdata and Vth represent the voltage of grayscale data and the threshold voltage of the first transistor T1, the first transistor T1 is in the cut-off state.

In addition, in the second time span, the gate electrode of the seventh transistor T7 is controlled by the first scan signal (i.e., scan[n] or Xscan[n]), and thus, when the first scan signal Xscan[n] is at a low voltage level, the seventh transistor T7 is in a conduction state. Accordingly, the light emitting device OLED connected to the seventh transistor T7 is proceeding with restoration. It needs to be explained that scan[n−1] is the (n−1)th scan signal, scan[n] is the n-th scan signal, Xscan[n] related to scan[n] can be the same as scan[n], and EM is the enabling signal or is called a light emitting control signal.

In a third time span, each of the gate electrodes of the first transistor T1, the eighth transistor T8, the fifth transistor T5, and the sixth transistor T6 is controlled by the enabling signal EM, and thus, when the enabling signal EM is at a high voltage level, the first transistor T1, the eighth transistor T8, the fifth transistor T5, and the sixth transistor T6 are in a cut-off state, wherein the third time span starts while a potential of the first reference point turns into be the difference between the voltage of grayscale data Vdata and the threshold voltage Vth of the first transistor T1 and while the first transistor T1 turns into be in a cut-off state, and the third time span ends while a timing period of the pixel driving circuit ends.

Figure 5:
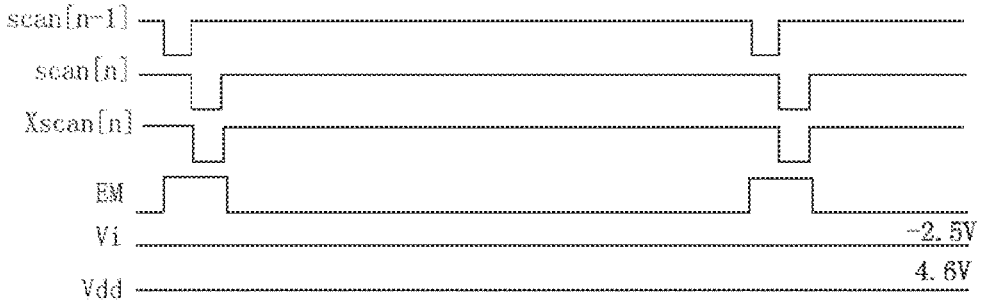
FIG. 5 is a driving time sequence diagram of pixels in an n-th row of a conventional 7T1C circuit.

In the embodiment, the third time span includes a plurality of first durations of high voltage level, in which the enabling signal EM keeps high, like a1, a2 shown in FIG. 4. Of course, the first durations of high voltage level can be denoted by X2, and they can be the same as each other or different. Compared with FIG. 5, which is a driving time sequence diagram of pixels in the n-th row of a conventional 7T1C circuit, in FIG. 4, which is a driving time sequence diagram of the pixel driving circuit of the invention, there are a number of signals which keep high in the enabling signal EM and in the third time span. In addition, in the embodiment, the first duration of high voltage level in which the enabling signal EM keeps high is set to be greater than or equal to the sum of the first time span and the second time span (i.e., X1=t1+t2). In this way, the first transistor T1, the fifth transistor T5, and the sixth transistor T6 are in an off state for a specific time in the whole of the third time span, and thus a thin film transistor (TFT) device is prevented from being in an on state for a long time.

Of course, in the third time span, when the enabling signal EM is at a low voltage level, the first transistor T1, the eighth transistor T8, the fifth transistor T5, and the sixth transistor T6 are in a conduction state.

Because the first transistor T1 and the eighth transistor T8 are in an on state, a gate-to-source voltage of the first transistor T1 is calculated by: Vgs=Vdd−(Vdata−|Vth|), where Vdd, Vdata and Vth represent a power voltage, the voltage of grayscale data, and the threshold voltage of the first transistor T1. At this moment in time, a current which passes through the first transistor T1 is calculated according to the formula:

$$I_{ds1} = \left(\frac{1}{2}\right)K[V_{dd} - (V_{ddata} - |V_{th}|) - |V_{th}|]^2 = \left(\frac{1}{2}\right)K(V_{dd} - V_{data})^2,$$

where K is a conducting parameter.

In the embodiment, the power voltage Vdd can be 4.6 volts, and a working voltage Vi is −2.5 volts.

The light emitting device OLED works in the third time span. Assume that scanning frequency of the pixel driving circuit is 60 hertz, that is, the gate driving time t1 or the gate driving time t2 is equal to: 1/60/(1440+blank), and is approximately 6 microseconds, wherein 1440 is a quantity of scanning lines and the blank is an amount of displacement.

Because the third time span is calculated by: t3=1/60−t1−t2, a driving time is roughly 16.7 milliseconds. In this time, the eighth transistor T8, whose a gate electrode is controlled by the enabling signal EM, is arranged between the first reference point and the first transistor T1 while a regular square wave signal is transmitted by the enabling signal EM in the third time span (i.e., displaying stage), causing a first transistor T1, a fifth transistor T5, and a sixth transistor T6 to be in an off state for a part of time of the displaying stage. Therefore, not only is a TFT device prevented from being in an on state for a long time without damages, but also the lifespan of the TFT device and the whole pixel driving circuit can be increased.

In addition, the foregoing light emitting device, which is not specifically limited in the embodiments of the invention, can be a light emitting diode (LED) lamp or an OLED and also can be one of other light emitting devices.

In addition, a display device, further provided in an embodiment of the invention, includes the foregoing pixel driving circuit. The concrete structure of the pixel driving circuit is not repeated here. Optionally, the display device includes, but not limited to, a display.

The foregoing discussions are merely some preferred embodiments of the invention, it should be noted that, for an ordinary skill in the art, under the premise of without departing from the principle of the invention, several improvements and modifications can be made, and these improvements and modifications should be included in the protection scope of the invention.

The topic of the application can be manufactured and used so that it has an industrial practicality.

What is claimed is:

1. A pixel driving circuit, comprising:

a light emitting device, a first transistor, a second transistor, a third transistor, a fourth transistor, a fifth transistor, a sixth transistor, a seventh transistor, and a first capacitor, wherein a first end of the light emitting device is electrically connected to a drain electrode of the sixth transistor and a drain electrode of the seventh transistor, a second end of the light emitting device is grounded, a positive terminal of the first capacitor receives a power voltage signal, a negative terminal of the first capacitor is electrically connected to a source electrode of the fourth transistor and a drain electrode of the third transistor, a gate electrode of the fourth transistor receives a second scan signal, a drain electrode of the fourth transistor receives a working voltage signal, a drain electrode of the second transistor receives a voltage signal of grayscale data, a source electrode of the second transistor is electrically connected to a source electrode of the first transistor and a drain electrode of the fifth transistor, a drain electrode of the first transistor is electrically connected to a source electrode of the sixth transistor, a gate electrode of the first transistor is electrically connected to the negative terminal of the first capacitor, the source electrode of the sixth transistor is electrically connected to a source electrode of the third transistor, a gate electrode of the sixth transistor and a gate electrode of the fifth transistor receive an enabling signal, a gate electrode of the third transistor receives a first scan signal, the drain electrode of the third transistor is electrically connected to the negative terminal of the first capacitor, a source electrode of the fifth transistor is electrically connected to the positive terminal of the first capacitor, a source electrode of the seventh transistor is electrically connected to the drain electrode of the fourth transistor, and a gate electrode of the seventh transistor receives the first scan signal; and an eighth transistor, wherein a drain electrode of the eighth transistor is electrically connected to the gate electrode of the first transistor, a gate electrode of the eighth transistor receives the enabling signal, and a source electrode of the eighth transistor is electrically connected to the negative terminal of the first capacitor; wherein:

in a first time span, when the second scan signal is at a low voltage level, the fourth transistor is in a conduction state, a first reference point at the negative terminal of the first capacitor turns into be at a low voltage level, and the first capacitor is in a charging state, wherein the first time span starts while the charge of the first capacitor begins, and the first time span ends while the charge of the first capacitor finishes; and in a second time span, when the first scan signal is at a low voltage level, the second transistor, the third transistor, and the seventh transistor are in a conduction state, wherein the second time span starts while the charge of the first capacitor finishes, and the second time span ends while a potential of the first reference point at the negative terminal of the first capacitor turns into be the difference between a voltage of grayscale data and a threshold voltage of the first transistor, and wherein the first transistor is in a cut-off state.

2. A pixel driving circuit, comprising:

a light emitting device, a first transistor, a second transistor, a third transistor, a fourth transistor, a fifth transistor, a sixth transistor, a seventh transistor, and a first capacitor, wherein a first end of the light emitting device is electrically connected to a drain electrode of the sixth transistor and a drain electrode of the seventh transistor, a second end of the light emitting device is grounded, a positive terminal of the first capacitor receives a power voltage signal, a negative terminal of the first capacitor is electrically connected to a source electrode of the fourth transistor and a drain electrode of the third transistor, a gate electrode of the fourth transistor receives a second scan signal, a drain electrode of the fourth transistor receives a working voltage signal, a drain electrode of the second transistor receives a voltage signal of grayscale data, a source electrode of the second transistor is electrically connected to a source electrode of the first transistor and a drain electrode of the fifth transistor, a drain electrode of the first transistor is electrically connected to a source electrode of the sixth transistor, a gate electrode of the first transistor is electrically connected to the negative terminal of the first capacitor, the source electrode of the sixth transistor is electrically connected to a source electrode of the third transistor, a gate electrode of the sixth transistor and a gate electrode of the fifth transistor receive an enabling signal, a gate electrode of the third transistor receives a first scan signal, the drain electrode of the third transistor is electrically connected to the negative terminal of the first capacitor, a source electrode of the fifth transistor is electrically connected to the positive terminal of the first capacitor, a source electrode of the seventh transistor is electrically connected to the drain electrode of the fourth transistor, and a gate electrode of the seventh transistor receives the first scan signal; and an eighth transistor, wherein a drain electrode of the eighth transistor is electrically connected to the gate electrode of the first transistor, a gate electrode of the eighth transistor receives the enabling signal, and a source electrode of the eighth transistor is electrically connected to the negative terminal of the first capacitor.

3. The pixel driving circuit according to claim 2, wherein, in a first time span, when the second scan signal is at a low voltage level, the fourth transistor is in a conduction state, a first reference point at the negative terminal of the first capacitor turns into be at a low voltage level, and the first capacitor is in a charging state, and wherein the first time span starts while the charge of the first capacitor begins, and the first time span ends while the charge of the first capacitor finishes.

4. The pixel driving circuit according to claim 2, wherein, in a second time span, when the first scan signal is at a low voltage level, the second transistor, the third transistor, and the seventh transistor are in a conduction state, wherein the second time span starts while the charge of the first capacitor finishes, and the second time span ends while a potential of the first reference point at the negative terminal of the first capacitor turns into be the difference between a voltage of grayscale data and a threshold voltage of the first transistor, and wherein the first transistor is in a cut-off state.

5. The pixel driving circuit according to claim 4, wherein, when a gate voltage of the first transistor is larger than the threshold voltage of the first transistor, the first transistor is in a conduction state, and the first reference point at the negative terminal of the first capacitor is charged by the voltage signal of grayscale data until the potential of the first reference point turns into be the difference between the voltage of grayscale data and the threshold voltage of the first transistor while the first transistor turns into be in the cut-off state.

6. The pixel driving circuit according to claim 2, wherein, in a third time span, when the enabling signal is at a high voltage level, the first transistor, the eighth transistor, the fifth transistor, and the sixth transistor are in a cut-off state, wherein the third time span starts while a potential of the first reference point turns into be the difference between the voltage of grayscale data and the threshold voltage of the first transistor and while the first transistor turns into be in a cut-off state, and the third time span ends while a timing period of the pixel driving circuit ends.

7. The pixel driving circuit according to claim 6, wherein the third time span comprises a plurality of first durations of a high voltage level, in which the enabling signal keeps high.

8. The pixel driving circuit according to claim 6, wherein one of the first durations of the high voltage level in which the enabling signal keeps high is greater than or equal to the sum of a first time span and a second time span.

9. The pixel driving circuit according to claim 2, wherein, in a third time span, when the enabling signal is at a low voltage level, the first transistor, the eighth transistor, the fifth transistor, and the sixth transistor are in a conduction state.

10. The pixel driving circuit according to claim 9, wherein a current which passes through the first transistor is calculated according to the formula:

$$I_{ds1} = \left(\frac{1}{2}\right)K[V_{dd} - (V_{data} - |V_{th}|) - |V_{th}|]^2 = \left(\frac{1}{2}\right)K(V_{dd} - V_{data})^2$$

where K is a conducting parameter.

11. The pixel driving circuit according to claim 2, wherein the first transistor, the second transistor, the third transistor, the fourth transistor, the fifth transistor, the sixth transistor, the seventh transistor, and the eighth transistor are P-type transistors.

12. A display device, comprising the pixel driving circuit according to claim 2.

* * * * *